US005808646A

United States Patent [19]

Kitahara et al.

[11] Patent Number: 5,808,646

[45] Date of Patent: Sep. 15, 1998

[54] PRINT MEDIUM CONVEYING UNIT AND PRINTING APPARATUS USING SAID CONVEYING UNIT

[75] Inventors: Yoshihiko Kitahara, Yokohama; Tsutomu Harada; Wang Li Shan, both of Tokyo, all of Japan

[73] Assignee: Canon Aptex Inc., Mitsukaido, Japan

[21] Appl. No.: 553,872

[22] Filed: Nov. 6, 1995

[30] Foreign Application Priority Data

Nov. 7, 1994 [JP] Japan ..... 6-272766

[51] Int. Cl.[6] ..... B41J 2/01

[52] U.S. Cl. ..... 347/104

[58] Field of Search ..... 347/104, 152, 347/218, 219

[56] References Cited

U.S. PATENT DOCUMENTS 5,274,544 12/1993 Iida ..... 400/120 X
5,356,229 10/1994 Hickman et al. ..... 347/8 X
5,579,042 11/1996 Ishida et al. ..... 347/217

FOREIGN PATENT DOCUMENTS 0 375 345 7/1990 European Pat. Off. .
0 622 224 11/1994 European Pat. Off. .
0 631 877 1/1995 European Pat. Off. .
4-27571 1/1992 Japan .

OTHER PUBLICATIONS

T. Kanno, et al., "Skew–Free Document Feed Mechanism," IBM Technical Disclosure Bulletin, vol. 25, No. 11B, Apr. 1983, pp. 6200–6201.

*Primary Examiner*—Edward Tso
*Attorney, Agent, or Firm*—Fitzpatrick, Cella, Harper & Scinto

[57] ABSTRACT

A print medium conveying unit for conveying a print medium to a plurality of printing positions with a plurality of print heads disposed along a conveyance direction of the print medium includes rotary members provided over the print face of the print medium between print heads. The rotary members suppress displacement from the print face of the print medium.

37 Claims, 6 Drawing Sheets

PRINT MEDIUM CONVEYING UNIT AND PRINTING APPARATUS USING SAID CONVEYING UNIT

BACKGROUND OF THE INVENTION

1. Field of the Invention

The present invention relates to a print medium conveying unit for conveying a print medium and a printing apparatus using said conveying unit, and more particularly to a print medium conveying unit for conveying a print medium through a plurality of printing positions satisfactorily, and a printing apparatus using said conveying unit.

2. Related Background Art

Conventionally, some recording apparatuses have been known in which a plurality of recording heads are arranged along a direction of conveying a recording sheet or the like, and the image recording is performed on the recording sheet by conveying the recording sheet to pass through a plurality of recording sites by the plurality of recording heads.

In such recording apparatuses, after recording by a recording head on the upstream side in the direction of conveying the recording sheet, and when conveying the recording sheet to the next recording site by a recording head subsequently located downstream, the rising of the recording sheet off a platen surface might occur. This causes the recording sheet to be brought into a space within the recording head out of the normal conveying path, because of, for example, a rolling recording sheet, oblique running of recording sheet, or the effect which the recording sheet undergoes from the recording head in recording (pressure applied by the recording head in case of a recording head of contact recording type, or deformation of the recording sheet due to sticking of ink droplets in case of a recording head of non-contact recording type). Therefore, there was a risk that the normal recording at the recording site downstream might be hampered, or the conveyance stop might occur due to jamming of the recording sheet.

To prevent such unfavorable conveyance of the recording sheet, an apparatus is known in which the recording sheet is adsorbed onto a platen by sucking the air from the back side of the platen through fine apertures punched on the platen supporting the recording sheet in a plurality of recording sites. Further, an apparatus is known in which the recording sheet is adsorbed onto the conveying surface of an endless conveying belt for conveying the recording sheet through a plurality of recording sites by means of static electricity or weak adhesives.

However, such a recording apparatus may require a pump device for suction, an electric apparatus for charging or discharging the endless conveying belt or the recording sheet, or a device for applying adhesives to the endless conveying belt, resulting in larger recording apparatus as such, or more complex recording process, with higher costs.

On the other hand, conventionally, there was a label sheet of the type in which a number of labels were successively bonded, easily releasably, on a lengthwise released paper called a separator as the recording sheet, but this label sheet was commonly in the form of having labels bonded on the separator, such labels made of thermal paper to effect thermal printing by means of a thermal head. Further, this separator was mostly formed like a roll and delivered to the recording apparatus.

The above-described technical problem was significantly serious, considering that when using a label sheet as the recording sheet, there was a risk that the label sheet might not be conveyed normally to the downstream recording site, since the label sheet might rise up from a mount, due to the above-mentioned phenomenon, though the released paper itself as the mount could be conveyed normally.

Furthermore, this problem is conceivably a very important subject, in that when using a recording apparatus of an ink jet system, as the recording system, in which a fixed gap is held contactless between the recording head and the recording sheet in recording, the label sheet may swell out to cause deformation like wrinkles or decrease the adhesive power of adhesives, due to sticking of ink droplets produced by the ink jet recording at a plurality of recording sites. This results is an abnormal condition of conveying the recording sheet as previously described, whereby it is expected that new problems may be possibly incurred, such as clogging of ink discharge ports with paper scraps produced by contact of the recording sheet with a member for guiding the recording sheet, false recording of image or clogging of ink discharge ports caused by contact of the recording sheet with the ink jet head disposed downstream, which was no problem in the case of the contact type recording system such as a thermal system or a thermal transfer system.

SUMMARY OF THE INVENTION

The present invention has been achieved in the light of aforementioned problem, and an object of the present invention is to provide a print medium conveying unit which can convey a print medium in good condition through a plurality of printing positions.

It is another object of the invention to provide a printing apparatus which can make excellent image prints by conveying a print medium in good condition through a plurality of printing positions.

It is a further object of the invention to provide a print medium conveying unit which can convey a print medium in good condition, while preventing a displacement beyond a predetermined amount off a print medium conveyance path between printing positions, in conveying the print medium through a plurality of printing positions, as well as a printing apparatus using said conveying unit.

It is a still further object of the invention to provide a print medium conveying unit which can convey a print medium with a recording sheet in good condition through a plurality of printing positions, with the recording sheet held on a sheet substrate.

It is another object of the invention to provide a printing apparatus which can make excellent image prints by conveying a print medium in good condition through a plurality of printing positions, with the recording sheet held on a sheet substrate.

It is another object of the invention to provide a print medium conveying unit for conveying a print medium to a plurality of printing positions with a plurality of print heads disposed along a conveyance direction of said print medium, comprising rotary members provided over the print face of said print medium between print heads mutually, said rotary members suppressing displacement from the print face of said print medium.

DETAILED DESCRIPTION OF THE PREFERRED EMBODIMENTS

The preferred embodiments of the present invention will be described below in detail with reference to the drawings.

It is to be noted that the following embodiments use the print medium in the form of roll paper where labels are successively arranged on a released sheet, but may use other print media in various forms, kinds or materials in conformance to the printer used. For example, the print medium may be a cut sheet, or may be of film, cloth or others. Also, in this embodiment, an ink jet print head of full-line type which can exhibit the most remarkable effect of the present invention is used, but a serial type ink jet print head can be also used, or other recording systems, e.g., a thermal head, may be used to obtain desired effects.

While this invention is described below with a label printer, it is of course possible that the printer of the present invention may take various forms in which the print medium is a scored continuous paper to be able to cut away, a calling card, other cards, or the form of a ticket vending machine.

Figure 1:
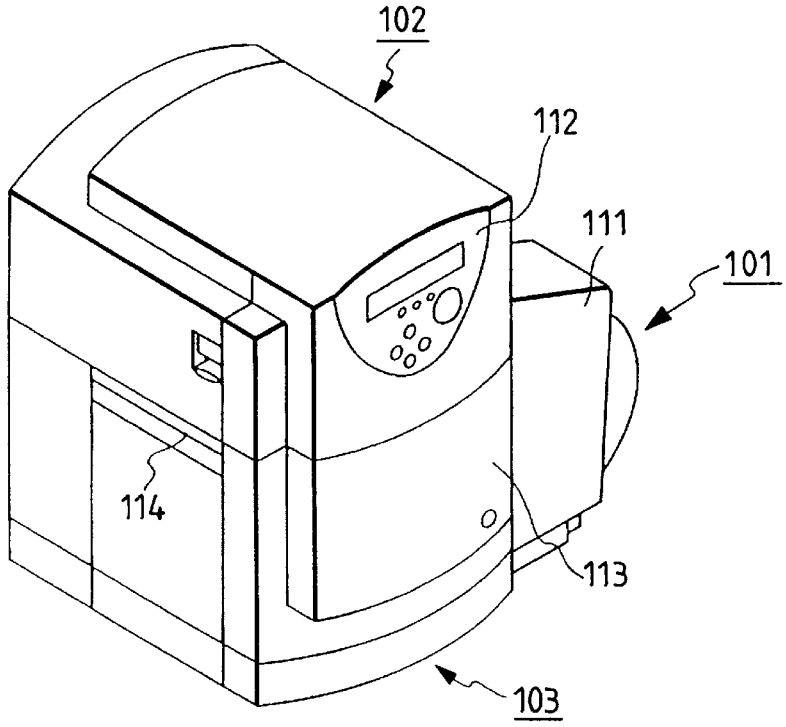
FIG. 1 is an external perspective view showing a label printer according to an embodiment of the present invention.

FIG. 1 is a perspective view showing the appearance of a label printer according to an embodiment of the present invention.

Figure 2:
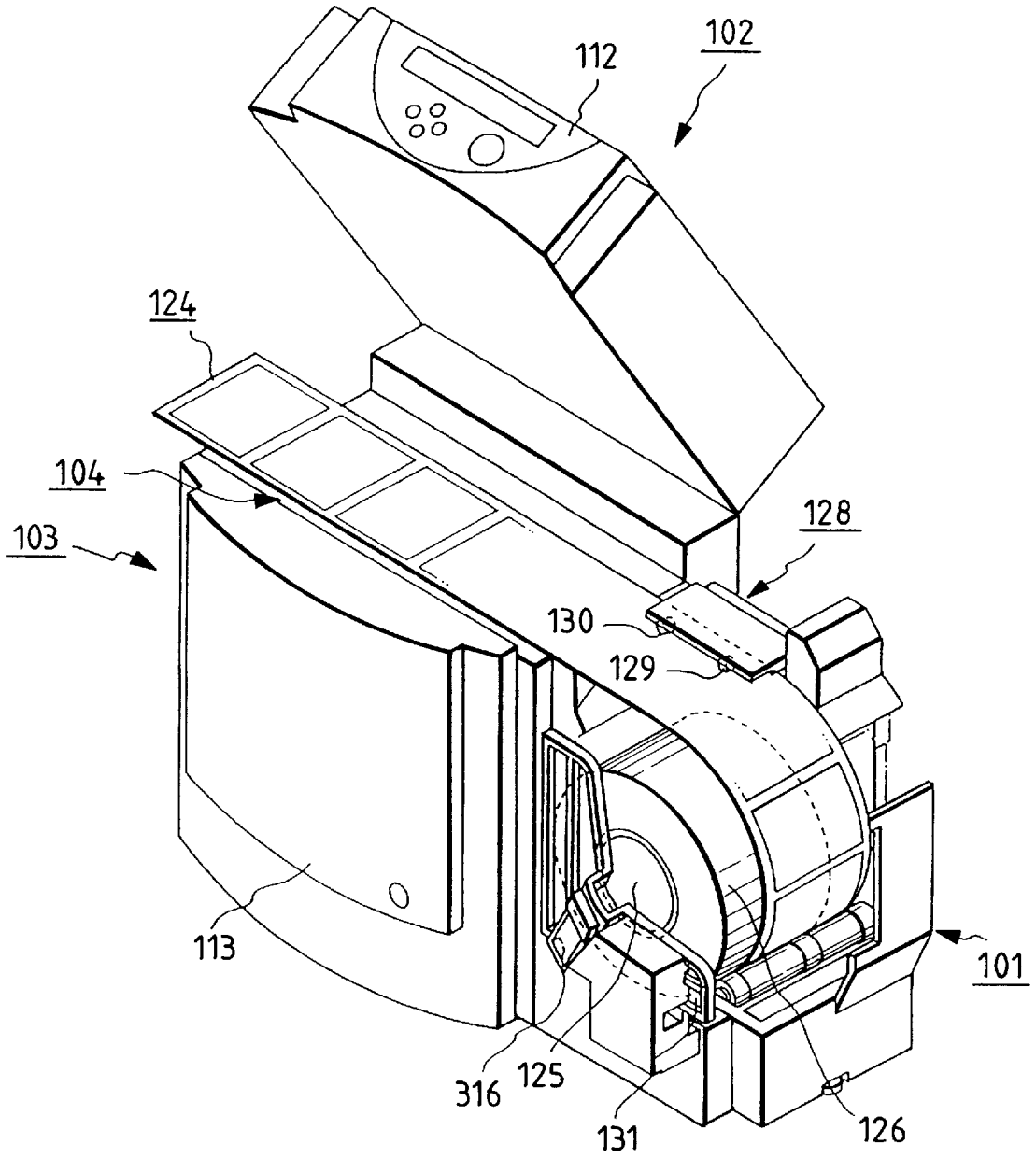
FIG. 2 is a perspective view showing the label printer as shown in FIG. 1, with its case cover removed.

The label printer of this embodiment uses a sheet in the form of roll paper in which labels are successively arranged on a released paper, and can be largely classified, in its arrangement or constitution, into three units, including a roll paper supply unit 101, a print head unit 102, and an ink cartridge accommodating unit 103. A cover 111 of roll paper supply unit 101 is detachably mounted, thereby enabling a new roll paper to be set. The roll paper accommodated within the roll paper supply unit 101, which is conveyed by a sheet conveying mechanism constructed between the print head unit 102 and the ink cartridge accommodating unit 103, as will be described later in connection with FIG. 2, is printed on each label by a print head of print head unit 102, and then exhausted via an exhaust opening 114 out of the apparatus. It is to be noted that a device for releasing a label from the released paper which is exhausted through the sheet exhaust opening 114, or a device for winding the released paper to be exhausted together with bonded labels, may be connected to the label printer of this embodiment.

The print head unit 102 is provided such that the whole head unit can be opened or closed around a support shaft at a back end portion in the cartridge accommodating unit 103, as will be described later in connection with FIG. 2, thereby allowing maintenance of a print head of print head unit 102, or a sheet conveying mechanism, or setting of the roll paper. At a front end portion of print head unit 102, there are provided a lamp or a liquid crystal display for informing various sorts of printer status, as well as an operation unit 112 equipped with operation keys.

A front cover 113 of the ink cartridge accommodating unit 103 can be opened or closed around a rotational shaft at an end portion to the left in the figure, thereby allowing mounting or dismounting of an ink cartridge by opening this front cover 113 for the replacement of the ink cartridge.

Figure 3:
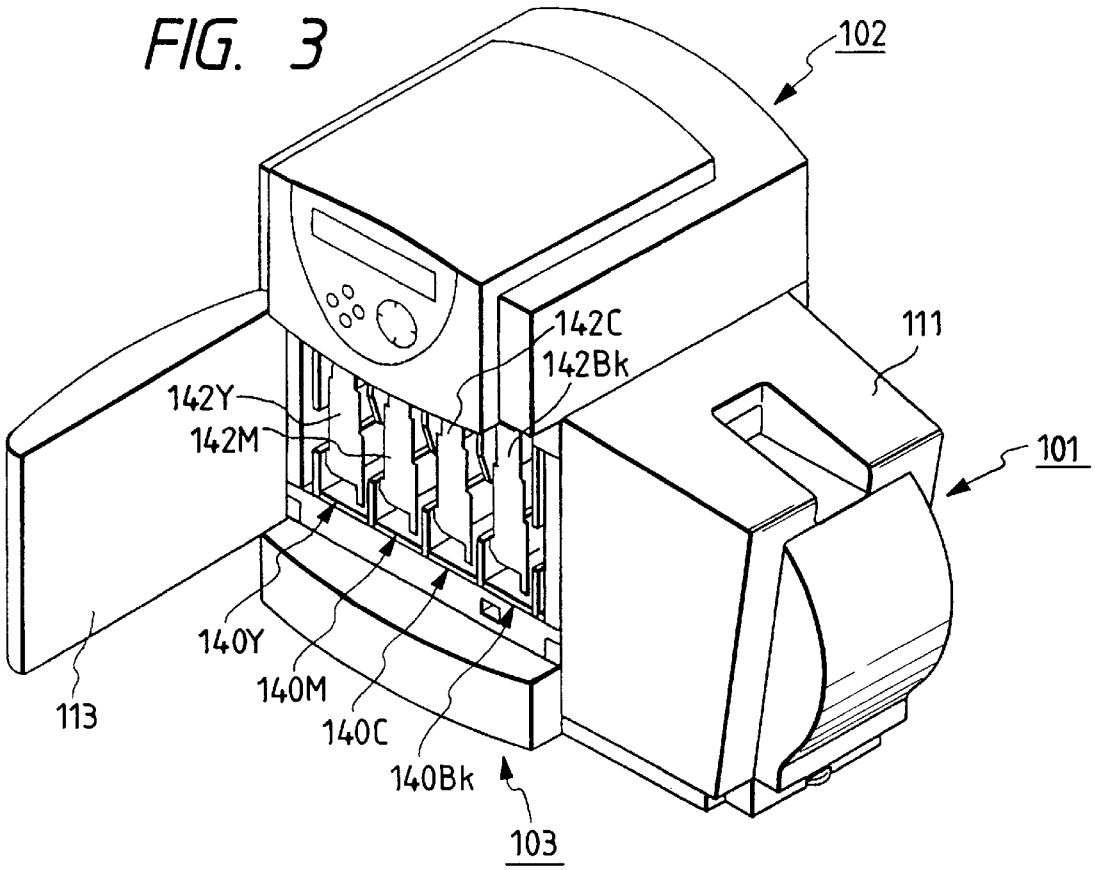
FIG. 3 is a perspective view showing the label printer as shown in FIG. 1, with its front cover opened.

FIG. 2 is a perspective view of the label printer as shown in FIG. 1, in which the cover 111 of roll paper supply unit 101 is removed and the print head unit 102 is turned upward into an open state, and FIG. 3 is a perspective view showing the label printer in the state where the front cover 113 of ink cartridge unit 103 is opened.

As shown in FIG. 2, a roll 126 around which the roll paper 124 accommodated within the roll paper supply unit 101 is wound is placed on two drive rollers 301 (one not shown) installed on the bottom of the unit 101, in which the external periphery of the roll 126 and the drive rollers are in contact owing to a pressure produced by its dead weight of the roll paper. In this state, by the above drive rollers 301 being rotated due to the motive power of a motor, not shown, the roll paper 124 is subjected to separation at the outermost turn from its inner roll paper and delivered therefrom. This supply of roll paper is performed, substantially independently of the conveyance by the roll paper conveying mechanism 104 (its details not shown) between the printer head unit 102 and the cartridge accommodating unit 103. Accordingly, to regulate the conveyance between these two units, the supply of roll paper is controlled to form a loop (slack, not shown in FIG. 2) which serves as a buffer in the roll paper supply as above described. That is, if a loop sensor (not shown) does not sense any loop in the conveyance by the conveying mechanism 104, the roll paper supply is performed while forming a loop by driving the above drive rollers.

A sheet guide 131 is slidably provided along a direction of the width of a roll 126 to be accommodated. That is, in accommodating the roll paper, the sheet guide 131 is slid beyond the width of roll paper 124 to place the roll 126 on the driving rollers, and then is slid up to the width of roll 126, so that a part of sheet guide 131 can be abutted against a core 125 of roll 126. Thereby, when the roll paper 124 is supplied, it is possible to regulate the roll paper 124, within a tolerance of minute deflection, from being swung widthwise upstream of the driving rollers in its supply direction. It is to be noted that the sheet guide 131 is provided with a stopper 316 for securing its slide position.

In the roll paper conveyance path, as obliquely feeding unit 128 is provided near an entrance into the conveyance path for the conveying mechanism 104. The obliquely feeding unit 128 has two obliquely feeding rollers (not shown) contacting with the lower surface of roll paper 124, and obliquely feeding rolls 129, 130 contacting with the upper surface of roll paper 124 placed opposed to those rollers. Two obliquely feeding rollers consist of a driving roller disposed opposite an obliquely feeding roll 130, and driven by a driving force from the conveying mechanism 104, and a driven roller disposed opposite an obliquely feeding roll 129 and not driven by any driving force, each roller being mounted to be rotated obliquely relative to the direction of conveying the roll paper (the rotational shaft is inclined from a direction orthogonal to the conveyance direction). Also, the obliquely feeding rolls 129, 130 are also mounted obliquely relative to the conveyance direction, like the obliquely feeding rollers. With these obliquely feeding rollers and obliquely feeding rolls 129, 130, the roll paper being conveyed is subjected to a conveying force obliquely directed, which acts to press the roll paper onto the predefined guide on the rear side in the figure. As a result, since the roll paper 124 is subjected to a regulation force to perform the conveyance in a fixed direction, it can be conveyed satisfactorily without fluctuations in the conveyance direction.

The roll paper conveying mechanism 104 provided between the print head unit 102 and the cartridge accommodating unit 103 is comprised of a plurality of belts disposed under the roll paper 124 (or accordingly on the upper surface of cartridge accommodating unit 103) and extending in the conveyance direction, though they are omitted in FIG. 2, rollers for driving them, provided upstream and downstream in the conveying direction, and spurs 141 (shown in FIG. 4) disposed under the lower surface of print head unit 102, each spur getting a driving force via a predetermined belt among the above-mentioned belts.

In FIG. 3, the ink cartridge accommodating unit 103 comprises four cartridge accommodating chambers 140Y, 140M, 140C, 14OBk, corresponding to four kinds of inks for use in the label printer in this embodiment, i.e., yellow (Y), magenta (M), cyan (C) and black (Bk). Near an entrance of each cartridge accommodating chamber, a shutter 142Y, 142M, 142C or 142Bk for substantially shuttering the inside of this accommodating chamber is provided. Those shutters have the upper portion supported rotatably, provided to protect the user from falsely putting a hand into the accommodating chamber and touching an ink supply needle. When inserting an ink cartridge, the cartridge itself forces a shutter to open to the rear side of accommodating chamber to achieve the insertion.

Figure 4:
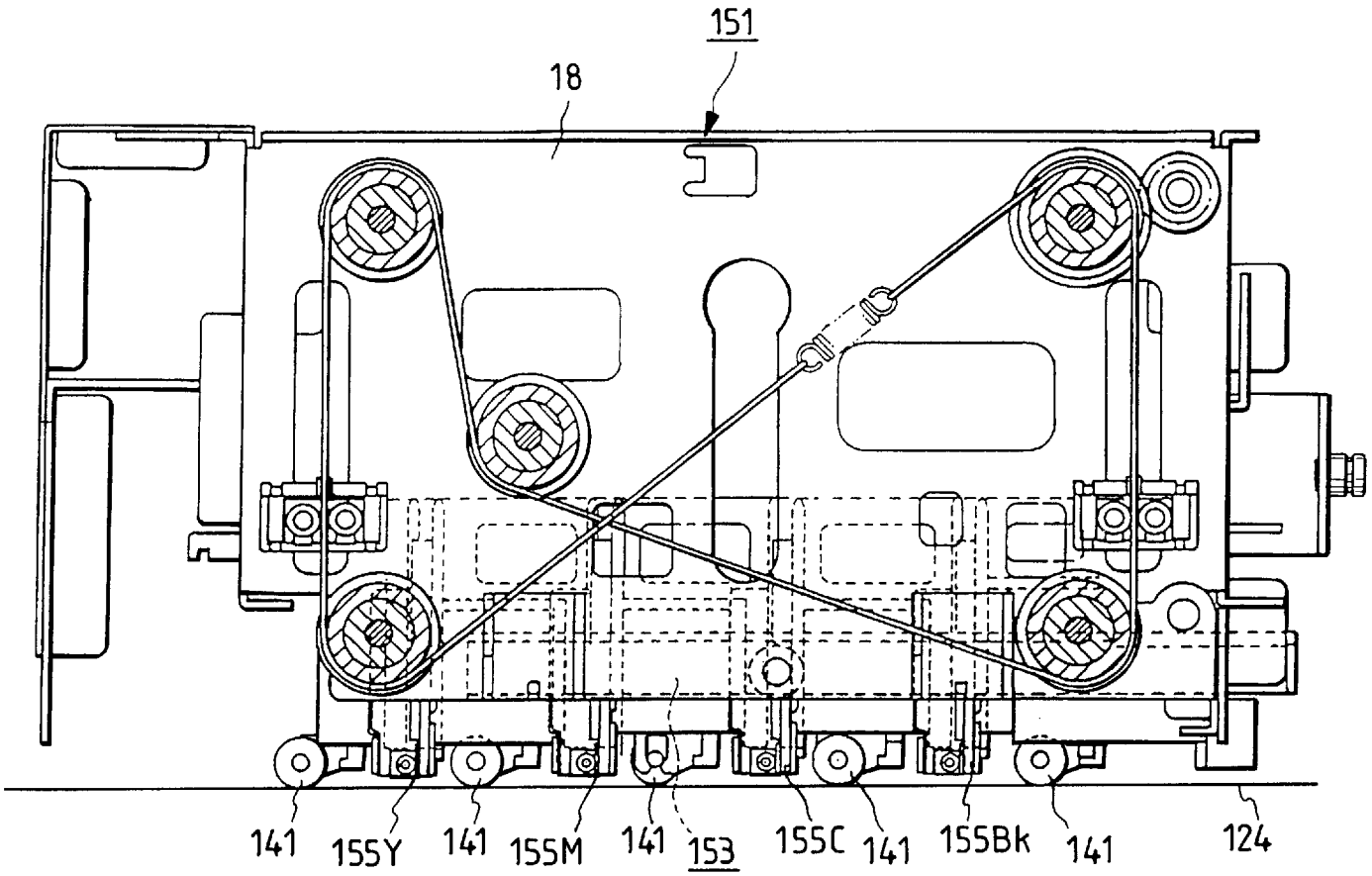
FIG. 4 is a front view showing a mechanism of a print head station (PHS) for the label printer as shown in FIG. 1.

FIG. 4 is a front view showing the constitution of a print head station 151 (hereinafter referred to as PHS) which is a main mechanism of the print head unit 102.

PHS 151 has an ink jet head (hereinafter referred to as a head) 155Y, 155M, 155C, 155Bk which has discharge ports arranged over the entire width of the label in a width direction of roll paper to make prints on labels placed on the roll label 124. This head is one having elements for generating thermal energy for causing film boiling in the ink as the energy for use to discharge the ink from the ink discharge ports. Also, PHS 151 has withdrawal means of the ink which is discharged out of the ink discharge ports disposed on each head, a blade for wiping and removing remaining ink on the discharge port formation face near the ink discharge ports of head, and a recovery system unit 153 having a cap for preventing drying around the ink discharge ports.

In PHS 151, there are provided a drive system unit for moving vertically a head holder unit 152 for supporting each head from the print position onto the roll paper 124, and moving the recovery system unit 153 horizontally along the roll paper conveyance direction a predetermined amount, and a cool unit for cooling the head.

Also, beneath the PHS 151, spurs 141 are provided on both sides of each head, as above noted.

While in the above description, the label printer was largely classified into three units, it is of course possible that each unit is not only provided with elements or mechanisms as described. Other relevant elements to those as described, or a control substrate, a driving motor, and an ink supply system, are appropriately disposed, wherein well-known elements can be used, except for each of elements or mechanisms as described below.

Next, the conveying mechanism 104 as above will be described in detail. While in the following embodiment the print medium is conveyed by means of the conveying belt 401, it will be appreciated that the print medium may be directly conveyed on a flat platen (print medium supporting surface), instead of using the conveying belt 401.

Figure 5:
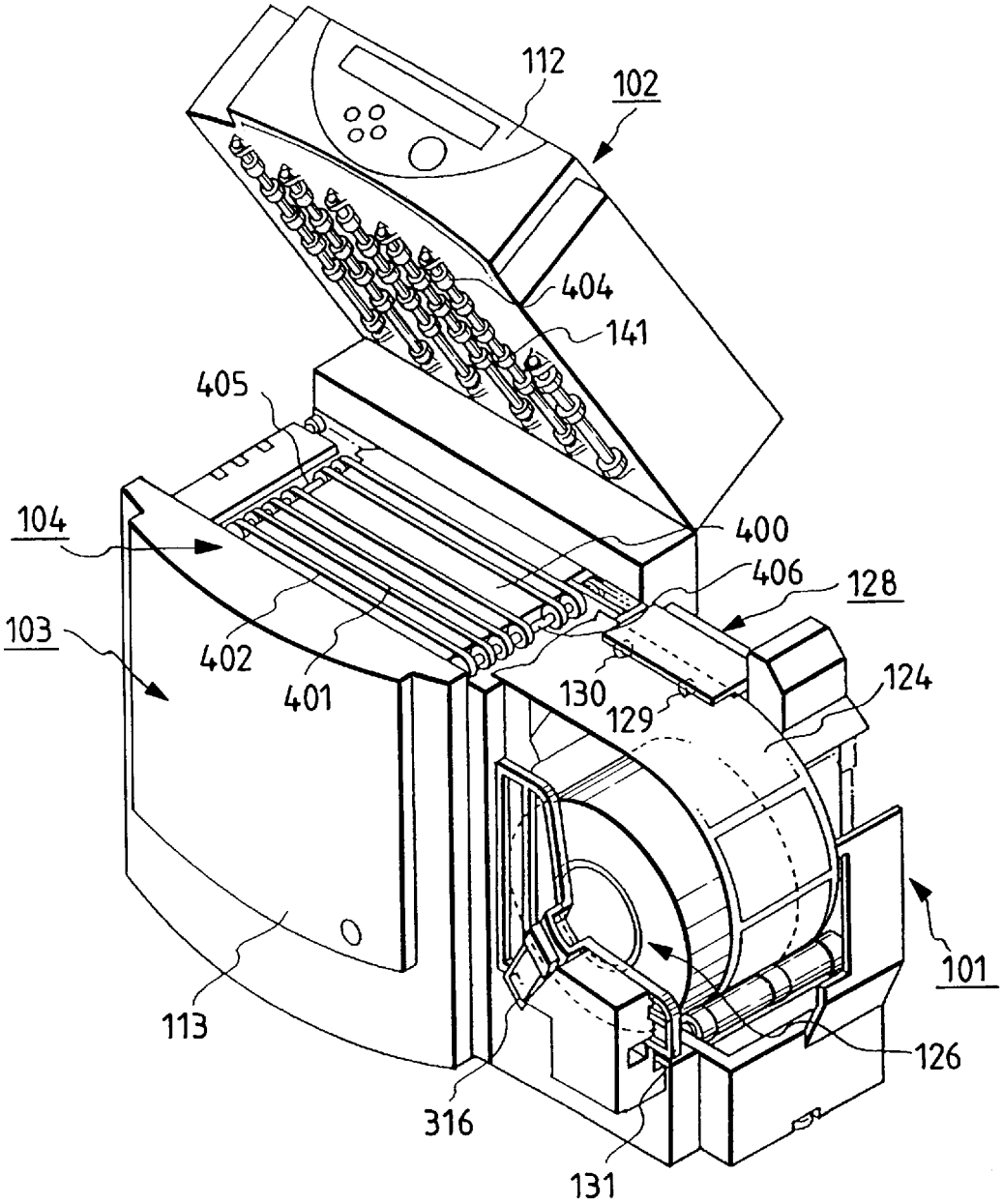
FIG. 5 is a perspective view for illustrating a conveying mechanism for the label printer as shown in FIG. 1.
Figure 6:
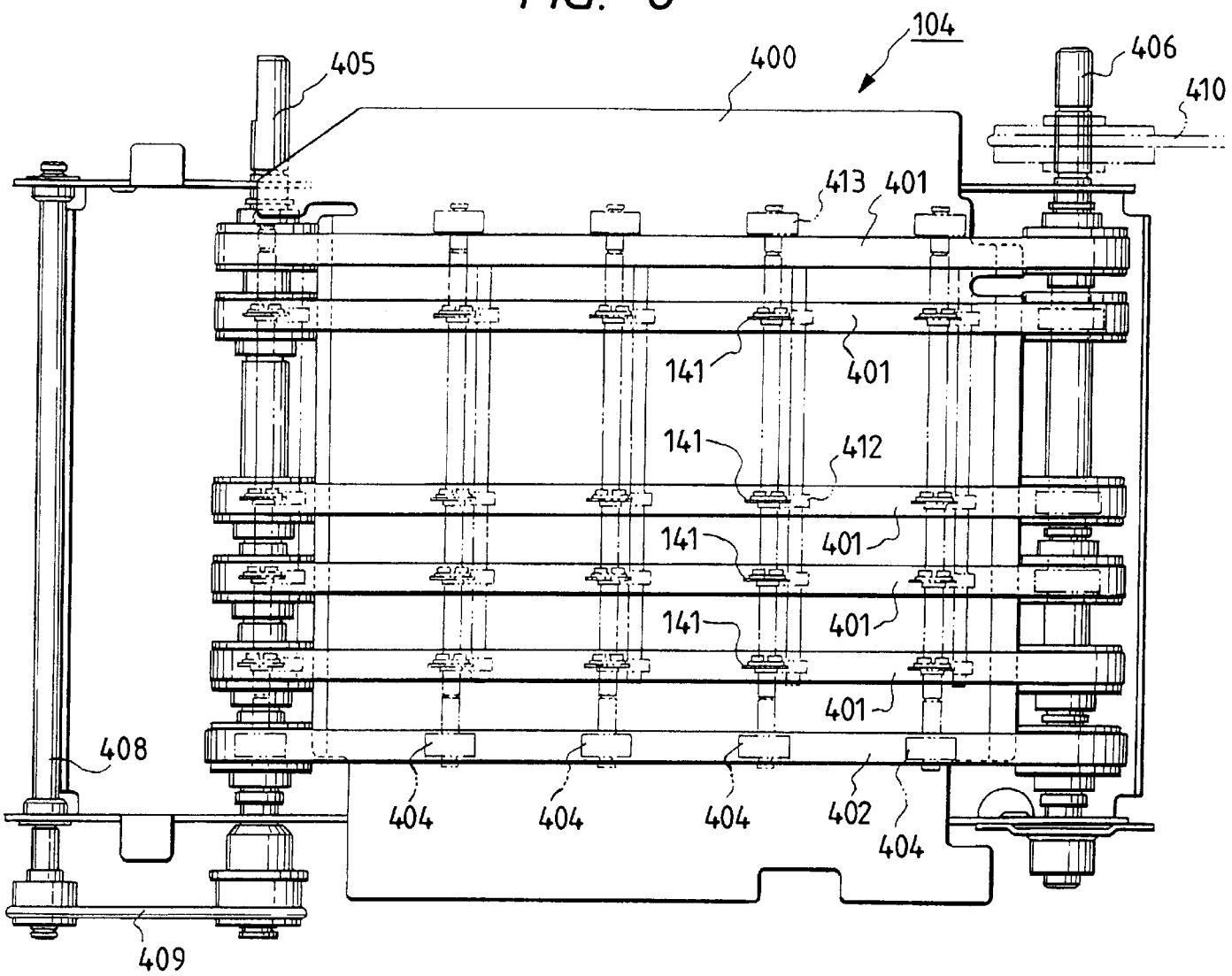
FIG. 6 is a plan view of the conveying mechanism as shown in FIG. 5.
Figure 7:
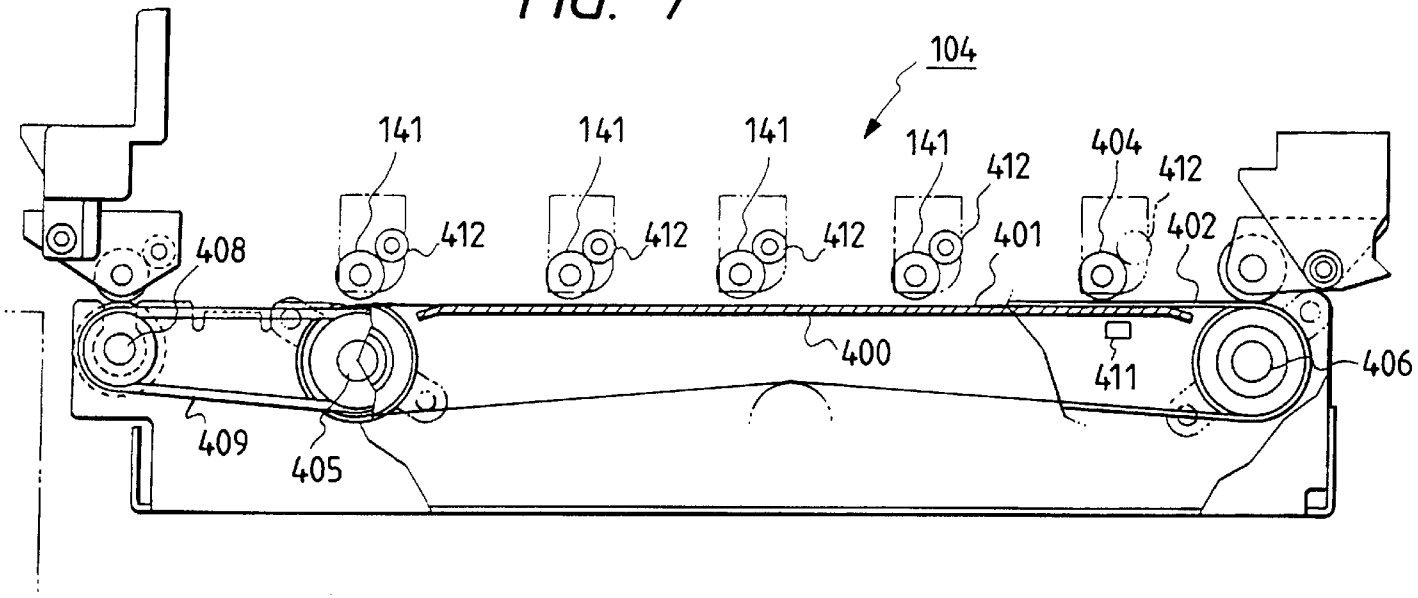
FIG. 7 is a side view of the conveying mechanism as shown in FIG. 5.
Figure 8:
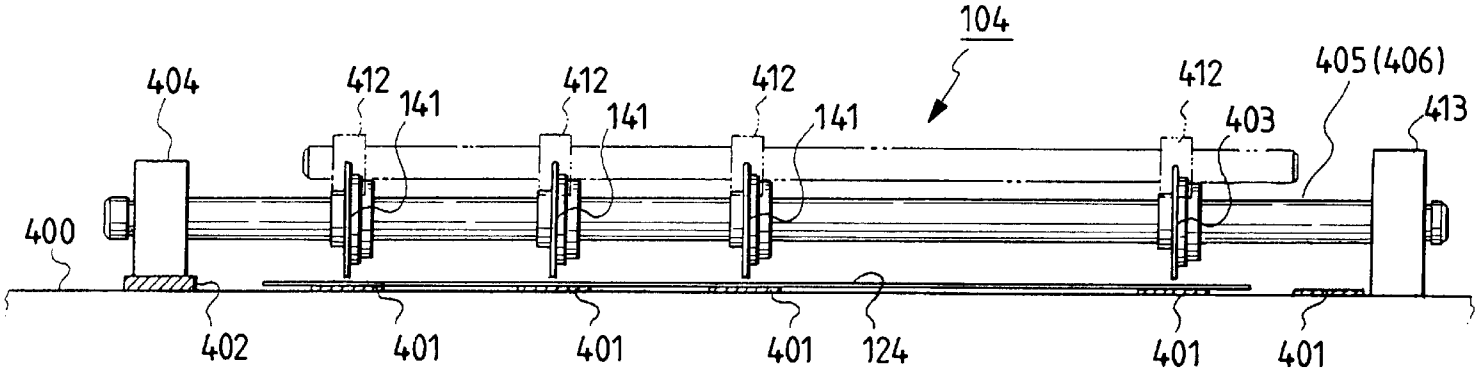
FIG. 8 is a front view of the conveying mechanism as shown in FIG. 5.

FIG. 5 is a perspective view showing the whole label printer including the conveying mechanism 104, FIG. 6 is a plan view of the conveying mechanism 104, FIG. 7 is a side view of the conveying mechanism 104, and FIG. 8 is a front view of the conveying mechanism.

The conveying mechanism 104 comprises a plurality of conveying belts 401 forming the conveyance surface on the platen 400, a spur driving belt 402 which is driven by the same driving source (omitted in the figure) as that for the plurality of conveying belts 401, and forms the drive plane on the platen 400 outside the roll paper 124 (as seen to the left and downward in FIG. 5) to be conveyed by the conveying belts 401, a plurality of spurs 141 disposed in suspension a predetermined height above the plurality of conveying belts 401, and pulleys 404 for sharing the rotational shaft with the plurality of spurs 141, and transmitting a rotational driving force to the spurs 403 by abutting with the spur driving belt 402.

The plurality of conveying belts 401 are stretched around the rotational shafts 405 and 406 disposed downstream and upstream of the platen 400, respectively. The provision of plural conveying belts 401 has the advantage that the use of a wide and expensive conveying belt can be avoided, and the assembling operation can be facilitated, compared to the wide conveying belt. It is needless to say that the thickness of the plural conveying belts 401 is all equal.

At one end of the rotational shaft 405 (on the rear side in FIG. 5), a conveyance drive motor, not shown, is attached, this drive force being transmitted to the rotational shaft 406 via the plural drive belts 401. Therefore, even with the provision of plural conveying belts 401, there is no variation in the conveying speed between conveying belts, so that the occurrence of any inconvenience, such as oblique running of the roll paper 124 to be conveyed, can be prevented. The other end of rotational shaft 405 is connected via a round belt 409 with a rotational shaft 408 of a waste paper system for the roll paper 124, as shown in FIGS. 6 and 7. Also, the other end of rotational shaft 406 is connected via a round unit 410 with the driving system of the obliquely running unit 128 as above. In either case, the connection via the round belt has the effect of improving the unevenness in conveyance.

The spur driving belt 402 is stretched between the rotational shafts 405 and 406, like the conveying belts 401. In this embodiment, the spur driving belt 402 is looped around the other end of each rotational shaft (on the fore side in FIG. 5). This position corresponds to the outside of the roll paper 124 to be conveyed by the plurality of conveying belts 401. Accordingly, the spur driving belt 402 is not directly involved in conveying the label sheet.

This spur driving belt 402 is abutted by pulleys 404 which share the rotational shafts with the spurs 141. A driving force from the spur driving belt 402 is transmitted via the pulleys 404 to the plurality of spurs 141.

These spurs 141 are provided on the lower portion of PHS 151, and set in suspended state a predetermined height above the roll paper 124 to be conveyed, when this PHS 151 is covered over the platen 400. Herein, the gap between the surface of roll paper 124 and the spurs 141 is normally set to 0.14 mm±0.05 mm, but is not particularly limited as far as it is in the range where the roll paper is satisfactorily conveyed to the next print position.

The height of spurs 141 above the platen 400 is adjusted so that the wall thickness of spur driving belt 402 is greater than that of the plurality of conveying belts 401 in this embodiment. With this method, it is possible to make the spurs 141 and the pulleys 404 of the same diameter, and render the peripheral speed of both equal. Of course, the above-mentioned height may be adjusted in such a way that the wall thickness of spur driving belt 402 is made equal to that of conveying belts 401, and the size of spurs 401 is made different from that of pulleys 404.

Also, the spurs 141 are disposed on the PHS 151 under the platen 400 and near a TOP sensor 411 disposed at a position upstream of the conveyance path, as shown in FIG. 7. This TOP sensor 411 is to sense a TOF (Top of Form) mark as a trigger for print start attached on the back side of roll paper 124. When this roll paper 124 is rising up, the separation distance between the TOP sensor 411 and the TOF mark may vary, resulting in less sensing accuracy, but owing to the presence of spurs 141 near the TOF sensor 411, the variation of the above separation distance can be suppressed to the minimum, thereby making it possible to raise the sensing accuracy.

Further, the plurality of spurs 141 are each equipped with a cleaner 412 made of an absorbing material. This cleaner 412 abuts against the marginal portion of spur 141 owing to its dead weight or an urging member such as a leaf spring, thereby allowing removal of adhering matter such as ink discharged by each ink jet head 155 onto the roll paper 124 constantly.

While in the above embodiment, the spur drive belt 402 was disposed to the fore side as shown in FIG. 5, it will be appreciated that the spur drive belt may be disposed to the rear side. When it is disposed to the rear side, the width of roll paper 124 to be conveyed is not limitative, but a wider roll paper 124 can be also conveyed and printed, with the advantage of having a higher degree of freedom for the applied sheet. In this case, pulleys 413 mounted at the end portion opposite pulleys 404 take over a rotational driving force transmission function to the spurs 141 which is a function of pulleys 404, while the pulleys 404 share a spacer function which is a function of the pulleys 413. For this purpose, the pulleys 413 are of the same diameter as the spurs 141, and the pulleys 404 are needed to be replaced with those having a radius equal to the radius of spurs 141 plus the thickness of spur drive belt 402.

It should be noted that the ink jet recording apparatus as above described may be used as an image output terminal for an information processing equipment such as a computer, and additionally take the form of a copying machine in combination with a reader, and further a facsimile apparatus having the transmission and reception function.

As above described, according to this embodiment, by providing spurs between a plurality of print heads, the print medium can be securely suppressed from rising up, even if it rises up during the conveyance, so that the contact between the discharge port face of print heads and the surface of print medium can be prevented. If the print head is of the ink jet print system, it is possible to make high quality prints on the print medium with the same method.

Also, by providing spurs suspended over the surface of the print medium, they normally make no contact with the print medium surface being conveyed, so that the production of paper powder from the print medium can be prevented, and the increase in conveyance load of the print medium can be suppressed, and further, when the print medium rises up, its rising part can be suppressed to prevent contact with the print head firmly.

Further, by rotating the spurs at the same speed as the conveying speed of print medium, even when the print medium rises up to make contact with spurs, the spurs will not impose any load on the conveyance, whereby it is possible to prevent oblique running of the print medium, and to perform the conveyance at a constant speed.

Also, by driving the print medium via a plurality of conveying belts to be driven by the same drive source, it is possible to prevent oblique running of the print medium securely by eliminating the variations in the conveying speed between the plurality of conveyance belts. Also, owing to the provision of the plurality of conveyance belts, the use of a wider and expensive conveyance belt can be avoided, and the cost can be reduced.

Further, by providing a spur drive belt to drive for rotation the spurs outside the print medium being conveyed, and making the spurs contacting with this spur drive belt and the pulleys sharing the rotational shaft with the spurs the same diameter, the peripheral speed of pulleys and spurs can be made equal to realize the conveyance at stable speed.

What is claimed is:

1. A printing apparatus for printing on a print medium by using an ink jet print head capable of recording along an entire width of the print medium conveyed, the ink let print head having ink discharge ports in a direction across a conveyance direction of the print medium, said printing apparatus comprising:

a print medium support member for supporting a back side of the print medium conveyed through a position opposed to the ink discharge ports of the ink let print head; and a rotary member provided opposite to and apart from a print surface of the print medium supported by said print medium support member and downstream of the conveyance direction of the print medium of the ink let print head, said rotary member regulating floating of the print medium from said print medium support member.

2. A printing apparatus according to claim 1, wherein said rotary member is provided at a position above the surface of the print medium being conveyed.

3. A printing apparatus according to claim 1, wherein said rotary member is driven at a rotation speed equal to a conveying speed of the print medium.

4. A printing apparatus according to claim 3, further comprising a plurality of conveying belts for driving the print medium, with said conveying belts being driven by a drive source that also drives said rotary member.

5. A printing apparatus according to claim 4, further comprising a rotary member driving belt for driving rotary members outside the print medium being conveyed.

6. A printing apparatus according to claim 5, wherein said rotary member driving belt transmits a drive force to said rotary members via pulleys contacting with said rotary member driving belt and shares a rotational shaft with said rotary members.

7. A printing apparatus according to claim 6, wherein said pulleys have the same diameter as said rotary members.

8. A printing apparatus according to claim 7, wherein said rotary member driving belt has a greater wall thickness than said plurality of conveying belts.

9. A printing apparatus according to claim 8, wherein a combination of said rotary members and said pulleys is disposed between a plurality of print heads.

10. A printing apparatus according to claim 1, wherein the ink let print head is a head of full-line type having a plurality of ink discharge ports arranged in a direction orthogonal to the conveyance direction of the print medium.

11. A printing apparatus according to claim 10, wherein the ink let print head has electricity-heat converters for generating heat energy to effect film boiling of the ink as the elements for generating the energy for use to discharge the ink.

12. A printing apparatus for printing on a print medium by using a plurality of ink let print heads provided along a conveying direction of the print medium, said printing apparatus comprising:

a print medium support member for supporting a back side of the print medium conveyed through an opposite position of each ink let print head; and a rotary member provided opposite to and apart from a print surface of the print medium supported by said print medium support member and between the ink let print heads, said rotary member limiting floating of the print medium from said print medium support member.

13. A printing apparatus according to claim 12, wherein said rotary member is provided above a surface of the print medium being conveyed.

14. A printing apparatus according to claim 13, wherein said rotary member is driven at a rotation speed equal to a conveying speed of the print medium.

15. A printing apparatus according to claim 14, further comprising a plurality of conveying belts for driving the print medium, with said conveying belts being driven by a drive source that also drives said rotary member.

16. A printing apparatus according to claim 15, further comprising a rotary member driving belt for driving rotary members outside the print medium being conveyed.

17. A printing apparatus according to claim 16, wherein said rotary member driving belt transmits a drive force to said rotary members via pulleys contacting with said rotary member driving belt and shares a rotational shaft with said rotary members.

18. A printing apparatus according to claim 17, wherein said pulleys have the same diameter as said rotary members.

19. A printing apparatus according to claim 18, wherein said rotary members have a greater wall thickness than said plurality of conveying belts.

20. A printing apparatus according to claim 19, wherein a combination of said rotary members and said pulleys is disposed between the plurality of ink jet print heads.

21. A printing apparatus according to claim 12, wherein each ink jet print head is a head of full-line type having a plurality of ink discharge ports arranged in a direction orthogonal to the conveyance direction of the print medium.

22. A printing apparatus according to claim 21, wherein each ink jet print head has electricity-heat converters for generating heat energy to effect film boiling of the ink as the elements for generating the energy for use to discharge the ink.

23. A printing apparatus for printing on a print medium holding recording sheets on a sheet base, comprising:

means for providing a plurality of printing positions disposed along a conveyance direction of the print medium, said means printing on the print medium with an ink jet print head of full-line type in which ink discharge ports are arranged over the entire width of the print medium in a direction transverse to the conveyance direction of the print medium;

a print medium support member having a support surface for supporting the print medium at a position opposed to said ink jet print head; and rotary members disposed at positions apart from said support surface beyond a distance corresponding to a thickness of the print medium conveyable between said printing positions, said rotary members rotating in the conveyance direction of the print medium at a rotation speed equivalent to the conveyance speed of the print medium and making contact with a print surface of the print medium rising up from the surface of said print medium support member and regulating the rising up of the print medium beyond a predetermined amount.

24. A printing apparatus according to claim 23, wherein the sheet base has a roll-like form.

25. A printing apparatus according to claim 23, wherein said print medium support member is an endless belt member having a surface supporting the print medium as an external peripheral face.

26. A printing apparatus according to claim 23, wherein said ink jet print head has electricity-heat converters for generating energy to discharge the ink.

27. A printing apparatus for printing on a print medium by using an ink jet print head capable of recording along an entire width of the print medium conveyed, the ink jet print head having ink discharge ports in a direction across a conveyance direction of the print medium, said printing apparatus comprising:

a print medium support member for supporting a back side of the print medium conveyed through a position opposed to the ink discharge ports of the ink jet print head; and a rotary member provided opposed to and apart from a print surface of the print medium supported by said print medium support member and upstream of the conveyance direction of the print medium of the ink jet print head, said rotary member limiting floating of the print medium from said print medium support member.

28. A printing apparatus according to claim 27, wherein said rotary member is provided at a position above the surface of the print medium being conveyed.

29. A printing apparatus according to claim 27, wherein said rotary member is driven at a rotation speed equal to a conveying speed of the print medium.

30. A printing apparatus according to claim 29, further comprising a plurality of conveying belts for driving the print medium, with said conveying belts being driven by a drive source that also drives said rotary member.

31. A printing apparatus according to claim 30, further comprising a rotary member driving belt for driving rotary members outside the print medium being conveyed.

32. A according to claim 31, wherein said rotary member driving belt transmits a drive force to said rotary members via pulleys contacting with said rotary member driving belt and shares a rotational shaft with said rotary members.

33. A printing apparatus according to claim 32, wherein said pulleys have the same diameter as said rotary members.

34. A printing apparatus according to claim 33, wherein said rotary member driving belt has a greater wall thickness than said plurality of conveying belts.

35. A printing apparatus according to claim 34, wherein a combination of said rotary members and said pulleys is disposed between a plurality of print heads.

36. A printing apparatus according to claim 27, wherein the ink jet print head is a head of full-line type having a plurality of ink discharge ports arranged in a direction orthogonal to the conveyance direction of the print medium.

37. A printing apparatus according to claim 36, wherein the ink jet print head has electricity-heat converters for generating heat energy to effect film boiling of the ink as the elements for generating the energy for use to discharge the ink.

* * * * *

UNITED STATES PATENT AND TRADEMARK OFFICE

CERTIFICATE OF CORRECTION

PATENT NO. : 5,808,646

DATED : September 15, 1998

INVENTOR(S) : YOSHIHIKO KITAHARA, ET AL.

It is certified that error appears in the above-identified patent and that said Letters Patent is hereby corrected as shown below:

On the title page,

Item [56] References Cited, Foreign Patent Documents, "0 375 345" should read --0 376 345--.

COLUMN 1,
Line 57, "releasably" should read --releasable--.

COLUMN 2,
Line 13, "is" should read --in--.

COLUMN 8,
Line 17, "let" should read --jet--;
Line 23, "let" should read --jet--;
Line 28, "let" should read --jet--;
Line 60, "let" should read --jet--; and
Line 64, "let" should read --jet--.

COLUMN 9,
Line 2, "let" should read --jet--;
Line 7, "let" should read --jet--; and
Line 10, "let" should read --jet--.

UNITED STATES PATENT AND TRADEMARK OFFICE

CERTIFICATE OF CORRECTION

PATENT NO. : 5,808,646

DATED : September 15, 1998

INVENTOR(S) : YOSHIHIKO KITAHARA, ET AL.

It is certified that error appears in the above-identified patent and that said Letters Patent is hereby corrected as shown below:

COLUMN 10,
Line 44, "A according" should read --A printing apparatus according--.

Signed and Sealed this

Fourth Day of May, 1999

*Attest:*

*Attesting Officer*

Q. TODD DICKINSON

*Acting Commissioner of Patents and Trademarks*